US006719618B2

(12) United States Patent
Homma et al.

(10) Patent No.: US 6,719,618 B2
(45) Date of Patent: Apr. 13, 2004

(54) POLISHING APPARATUS

(75) Inventors: Yoshio Homma, Hinode (JP); Seiichi Kondo, Kokubunji (JP); Noriyuki Sakuma, Hachioji (JP); Youhei Yamada, Kodaira (JP); Takeshi Kimura, Higashimurayama (JP); Hiroki Nezu, Hamura (JP)

(73) Assignee: Renesas Technology Corp., Tokyo (JP)

( * ) Notice: Subject to any disclaimer, the term of this patent is extended or adjusted under 35 U.S.C. 154(b) by 0 days.

(21) Appl. No.: 09/811,496

(22) Filed: Mar. 20, 2001

(65) Prior Publication Data

US 2001/0051500 A1 Dec. 13, 2001

(30) Foreign Application Priority Data

May 30, 2000 (JP) ..... 2000-164706

(51) Int. Cl.[7] ..... B24B 1/00

(52) U.S. Cl. ..... 451/286; 451/285; 451/398; 451/288; 451/289

(58) Field of Search ..... 451/398, 388, 451/41, 285–289

(56) References Cited

U.S. PATENT DOCUMENTS 5,851,140 A * 12/1998 Barns et al. ..... 451/288
6,083,083 A * 7/2000 Nishimura ..... 451/288
6,099,393 A * 8/2000 Katagiri et al. ..... 451/56
6,110,024 A * 8/2000 Togawa ..... 451/285
6,110,026 A * 8/2000 Arai ..... 451/286
6,165,058 A * 12/2000 Zuniga et al. ..... 451/287
6,227,955 B1 * 5/2001 Custer et al. ..... 156/345.14
6,241,593 B1 * 6/2001 Chen et al. ..... 451/288
6,251,215 B1 * 6/2001 Zuniga et al. ..... 156/345.12
6,273,803 B1 * 8/2001 Wang et al. ..... 451/288
6,277,008 B1 * 8/2001 Masuta et al. ..... 451/285
6,283,834 B1 * 9/2001 Liauzu ..... 451/285

FOREIGN PATENT DOCUMENTS

JP 01-193166 * 3/1989 ..... 451/41
JP 04-310365 * 2/1992 ..... 451/41

* cited by examiner

*Primary Examiner*—George Nguyen
(74) *Attorney, Agent, or Firm*—Antonelli, Terry, Stout & Kraus, LLP

(57) ABSTRACT

In a polishing apparatus having a cover body with fluid pressing mechanism, during polishing, vibration and migration of sticking portion between a retainer and a membrane generated in downstream of rotation of a polishing platen is prevented by reducing sticking force between the retainer and the membrane to less than force needed to wafer polishing with rotation of the cover body.

15 Claims, 6 Drawing Sheets

POLISHING APPARATUS

FIELD OF THE INVENTION

The present invention relates to a polishing apparatus, which, in particular, is suitable for planarization of surfaces of work pieces such as semiconductor wafers for semiconductor integrated circuit devices with a multilayer interconnection comprising a plurality of metal films.

BACKGROUND OF THE INVENTION

Recently, it is seen that planarization of surfaces of interconnect substrates for large scale semiconductor integrated circuits (referred to as "LSI"s hereafter) is important. One of representative techniques for the planalization is the Chemical Mechanical Polishing; CMP (referred to as "polishing" as long as there is not any notification).

The polishing techniques are classified roughly into two processes:

- a process utilizing a mechanical polishing property of abrasive grains; and
- a process dominantly utilizing a chemical surface reaction effect with polishing with abrasive grains enhancing the reaction.

The former process is mainly used for planarization of insulator films such as silicon oxide ($SiO_2$), alumina ($Al_2O_3$), or silicon nitride (SiN). An example, in which polishing of $SiO_2$ is applied to semiconductor integrated circuit fabrication, is described, for example, "PROCEEDINGS VLSI MULTILEVEL INTERCONNECT CONFERENCE 1991, A POUR-LEVEL-METAL FULLY PLANARIZED INTERCONNECT TECHNOLOGY FOR DENSE HIGH PERFORMANCE LOGIC AND SRAM APPLICATIONS" 20–26. Concentration of abrasive grain in slurries for these polishing process is generally high, often ranging in 10–25 weight percent.

The latter process, in which chemical reaction mainly works, is mainly used for metal-film planarization, and described in detail, for example, in JP-A-2-278822 specification and JP-A-8-83780. Concentration of abrasive grain in the slurries is often 5 weight percent or less. A process, in which metal-films are polished in a liquid containing substantially no abrasive grain, is disclosed JP-A-11-195628.

It is assumed that an in-between process of the above two processes is polishing of (Si) substrate. Slurry for insulator is used in the substrate polishing, but it is thought that dominance of chemical reaction effect with respect to mechanical polishing effect in the substrate polishing process is greater than the one in $SiO_2$ polishing process.

Additionally, processes to polish silicon wafers, glass substrates, or the like, in which instead of polymer-resin polishing pad, a polishing pad with fixed abrasive grains such as silica or cerium oxide (referred to as "grindstone" hereafter) is used and slurry itself does not contain any abrasive grain, are disclosed in such as JP-A-10-125880 or JP-A-8-64562. A process to polish copper using similar grindstone is described in "PROCEEDINGS SEMI TECHNOLOGY SYMPOSIUM 1998, A NEW SLURRY-FREE CMP TECHNIQUE FOR CU INTERCONNECTS" 5–72 to 5–78. However consideration must be made, since principle of each of above methods using such fixed abrasive grains is similar to principle of polishing using slurry with respective abrasive grain and therefor the method easily generate polishing damage while having good planarizing effect.

It is necessary that polishing is performed uniformly over a predetermined area of an interconnect wafer when above mentioned polishing process is applied for planarization of surface of the interconnect wafer. In order that polishing is performed uniformly, it is needed that at least a surface of an interconnect wafer, which is to be polished, is pressed onto a polishing pad with uniform pressure. For uniform pressing, a variety of polishing apparatuses, particularly carrier structures to hold an interconnect substrate therein and mechanism for applying uniform pressure onto an interconnect substrate in the carriers, are being developed.

Fluid pressing mechanism is known as a carrier structure suitable for uniform pressing. As the fluid pressing mechanism, two type is known; a type of mechanism in which pressure is applied with air or liquid onto backside of an interconnect wafer (referred to as "direct fluid pressing mechanism" hereafter), and a type of mechanism in which pressure is applied by pressing a flexible rubber-like sealed bag onto backside of an interconnect substrate (referred to as "fluid bag mechanism").

The latter, as an example described in "The Japan Society for Precision Engineering, Autumn Conference 1991, conference paper publication, TRIAL MANUFACTURE AND BASIC CHARACTERISTICS OF POLISHING APPARATUS" 211–212, has a structure wherein pressure applied onto a carrier is transmitted through a fluid bag constituted by a balloon-like membrane to an interconnect substrate and wherein an annular retainer surrounds an interconnect substrate to confine the substrate during polishing. Pressing onto an interconnect substrate is carried out by filling gas within the fluid bag. It is assumed that pressing with such fluid bag provides uniform pressing over backside of an interconnect substrate. In this example, the fluid bag is not secured to periphery of a substrate. Sealed container filled with fluid is pressurized by a weight. Since the weight or the fluid bag is not fixed, a guide is further provided outside of the retainer in order to prevent them coming off.

As described above, polishing apparatuses in which a weight or a fluid bag is not secured to a guide, are not suitable for polishing of many interconnect substrates since load and unload of an interconnect substrate are complicated. To solve the problem, a mechanism wherein a fluid bag is secured to a carrier is used recently.

The portion of a carrier that contacts with an interconnect substrate is provided with substantially planar surface, since once foreign materials infiltrate into the mechanism when polishing is performed they may generate polishing damage or contamination. For example, surface and inner surface of the retainer are finished with surface smoothness such that they have luster. A membrane composing the fluid bag is flexible and made of flexible rubber material with large friction such as neoprene or soft silicone. Therefor the membrane does not have luster like the retainer, but is finished with generally smooth surface. In the direct fluid pressing mechanism, rubber-like or polymer-resin-like layer with smooth surface is made contact only with periphery of backside of an interconnect substrate, and pressing is then carried out by increasing fluid pressure on the backside of the interconnect substrate while retaining them in sealed states or the similar states.

In all cases above mentioned for fluid pressing mechanism, torque for rotating an interconnect substrate is first applied to the carrier, then applied to the interconnect substrate through elastic material or thin film of rubber-like material or polymer resin. The interconnect substrate is thus supported flexibly, and a characteristic is provided that a substrate is secured to carrier or other transfer mechanism while allowing twist and eccentricity. Such mechanism in a polishing apparatus with fluid pressing mechanism consists of membrane composing flexible portion contacting with an interconnect substrate and a flexor that connects a carrier with the membrane.

As described above, for use in polishing of interconnect substrates for such as semiconductor integrated circuit devices, a variety of slurries that have not only mechanical effect but also surface chemical reaction effect, and polishing apparatuses comprising a carrier with fluid pressing mechanism such as fluid bags, have been developed.

However, a problem for unstable polishing arise in that polishing by using such polishing apparatus with fluid pressing mechanism and chemical-effect-dominant slurry often results in periodical high frequency sound (high frequency noise) generation and significantly lowered polishing rate. Such unstable polishing usually does not occur when slurry for insulator is used, but frequently occurs when slurry utilizing surface chemical reaction and having abrasive grain at concentration of 5 weight percent or less, i.e. slurry for metal containing substantially no abrasive grain, is used. When slurry substantially no abrasive grain is used, unstable polishing does not occur if a conventional polishing apparatus with pressing mechanism other than fluid pressing mechanism.

As described above, there is a problem that it is difficult to utilize in stable manner the combination of chemical-reaction-dominant slurry containing low or substantially no abrasive grain and causing little surface damage of interconnect substrates, and a polishing apparatus with fluid pressing mechanism providing good uniformity.

SUMMARY OF THE INVENTION

The present invention provides a polishing apparatus suitable for workpieces such as semiconductor wafers for semiconductor integrated circuit devices.

The present invention further provides a polishing apparatus for improving polishing performance and for reducing high frequency noise generation when polishing a workpiece such as semiconductor wafers in semiconductor integrated circuit devices manufacturing.

The present invention further provides a polishing apparatus for semiconductor integrated circuit devices for polishing a surface of metal film into stable and planarized state using slurry, or polishing solution (or polishing agent) containing substantially no abrasive grain.

The inventor first assumed that sliding occurs between a workpiece (referred to as "wafer" hereafter) and a membrane, causing wafer vibration during polishing. Based on the assumption, porous resin layer was inserted between the membrane and a wafer to increase the friction between them, but substantial improvement was not made. Additionally, based on an assumption that the too flexible membrane causes pressing unstable, membrane hardness was increased, but any substantial effect was obtained.

Regarding causes of such unstable polishing, the inventors noticed the fact that polishing is stably performed with mechanical-effect-dominant slurry containing high concentration of abrasive grain even if the fluid pressing mechanism is used. Therefore, to slurry containing substantially no abrasive grain, described in JP-A-11-195628, alumina powder was added as abrasive grain such that the mixture had concentration of 10 weight percent of alumina. The polishing was then applied copper film on a wafer surface using the 10 percent mixture. It was then confirmed that above mentioned unstable polishing did not occur.

The present invention is directed to slurry with concentration of abrasive grain of 5 percent or less, and polishing solution (or polishing agent) to which no abrasive grain is intentionally added. There are many differences in composition and feature between above two substances, but both have same behavior regarding the object of the present invention. In this sense, both will be referred to as "slurry containing substantially no abrasive grain", hereafter.

Based on those characteristics, the inventor found that high frequency noise is generated through mechanism described below, and came up with a measure to reduce the noise from a viewpoint of the mechanism, then verified that the measure is effective.

When slurry with high concentration of slurry in a polishing apparatus with fluid pressing mechanism is used, a fluid bag first (hence a membrane,) expands for pressing. Since a polishing pad is moving relatively with respect to the wafer (,hence providing relative motion,) during polishing, a membrane side of the fluid bag in the carrier contacts with inner wall of the retainer at the most downstream portion of the relative motion. Because the fluid bag has certain degree of freedom with respect to rotation of entire carrier, and friction between the wafer and a surface of the polishing pad on a polishing platen is large, the fluid bag does not necessarily follow the rotation of the carrier or retainer completely, and it may cause twist of the membrane or flexor, or eccentricity of the membrane. However, since abrasive grains infiltrated between membrane and retainer are sandwiched between the membrane side and the retainer, the contacting between them is maintained stably, and the fluid bag continues to rotate with the twist with certain delay with respect to the carrier.

As a contrast, when slurry containing abrasive grain in low concentration of 5 weight percent or less, or substantially no abrasive grain is used, the effect of abrasive grain is not sufficient so that side of the membrane contacts with inner wall of the retainer at the most downstream potion of the relative motion on start of polishing. When slurry contains abrasive grain as well surfactant, even though it contains abrasive grain, the side of membrane sticks tightly with the retainer, causing the membrane and a wafer to rotate following rotation of the carrier and retainer.

The force needed to break the sticking state (referred to as "sticking force" hereafter) is a power generated by the relative motion between a wafer and the polishing pad. In other hand, a predetermined force is needed to rotate a wafer through carrier, and is referred to as "rotational friction". In the case of slurry with low concentration of abrasive grain, rotational friction is less than sticking force. However, as the carrier rotation is continued, thus the sticking portion moves laterally or upstream from the most downstream, sticking force between the retainer and membrane is reduced, and the sticking state is broken at the moment when sticking force become less than rotational friction, then new sticking portion is generated at the most downstream portion of the relative motion.

In repeating such separation of sticking portion or generation of new sticking portion, high frequency noise is generated due to friction or vibration between side of the membrane and a inner wall of the retainer. Such vibration lowers sticking firmness between a wafer and the polishing pad, reducing polishing rate. The inventers found those facts.

The inventers also found that in order to prevent such generation and breakup of sticking potion, and generation of new sticking portion, methods described below is effective.

In the specification, since a carrier comprising a case (box body) to which an elastic membrane secured, and retainer (wafer receptor) attached to bottom of the case covers side and a backside of a wafer placed on a polishing platen, the carrier is referred to as "cover body". Additionally, the carrier is referred to as "wafer holder", since the carrier hold a wafer over the polishing platen during polishing with fluid pressure within the carrier.

The inventor found that stable polishing is provided without high frequency noise generation by using polishing apparatus employing one or combination of following three methods. The first method is such that sticking force between the membrane and the retainer (a receptor of a workpiece like a wafer) is reduced to less than rotational friction. The second method is such that the retainer is made rotatable with respect to the case (box body) of the carrier (cover body or holder for a wafer) so that sticking portion between the retainer and the membrane does not move. The third method is such that flexor strength is increased so that the membrane does not easily stick to the retainer.

Specifically, in the first method, by composing inner wall of the retainer, which contacts at least with the membrane, of material to reduce the sticking force between the membrane and the retainer to less than the rotational friction, it is ensured that sticking portion is always at the most downstream portion. Fluorocarbon resins such as tetrafluoroethylene or trifluoroethylene, are suitable for such material.

Another method to lower the sticking force is to provide grooves or height variation in surface of the inner wall of the retainer such that the retainer does not easily sticks to the membrane. It is confirmed that depth and pitch of the groove or height variation is preferably larger than size of abrasive grain size of used slurry, and size larger than 10 micron provides practical and stable lowerd sticking force. By provision of plurality of such grooves in longitudinal or lateral direction, abrasive grain or slurry is actively retained in the groves.

A still further method is to lower sticking force by coating fluororesin in thickness of 10 micron to 100 micron onto side of membrane opposing to inner wall of the retainer, or by providing side of the membrane with grooves or height variation. Combination of them can further reduce sticking force and is thus effective in prevention of unstable polishing.

In any of above methods, pressure of fluid is controlled, the fluid is introduced to expand the membrane such that a wafer rotates while the side of the membrane is pressed onto the inner wall of the retainer to contact therewith.

In the second method, a retainer has a structure to be rotatable with respect to the case of the carrier so that the retainer and membrane always can rotate together and sticking portion therebetween is retained stably at the most downstream of the relative motion without undesired friction. The method is in principle most suitable for prevention of unstable polishing. However, it preferably use a structure such that it can decrease possibility that abrasive grains or foreign particle infiltrate into the mechanism which allows the retainer rotate with respect to the carrier case, generating new particles, then generating polishing damage.

In the third method, strength of a flexor, which is an elastic fixing member for the membrane, is increased so that sticking between a membrane and a retainer, or migration of sticking potion does not easily occur that would otherwise occur due to twist. As a flexor, thin film of rubber or polymer resin in thickness of 0.5 mm or less may be used, however it is preferable that the thickness is more than 0.5 mm and that the effective strength is increased more than two times by using harder material. Thin plate made of stainless steel or phosphor bronze that has good elasticity, or hard resin with high wear resistance such as polyurethane resin, fluorine-contained resin, silicone resin, or nylon resin, is suitable for the hard material. Since this method allows membrane to move upward and downward with respect to the retainer, the membrane does not easily twist with respect to the entire carrier, and not easily stick to the retainer due to deformation. However, a caution should be made that too high flexor strength lowers polishing uniformity.

By using one of above described methods, or any combination of them, generation of high frequency noise and unstable polishing can be prevented. Particularly, it is significantly effective in polishing of metal film with slurry containing substantially no abrasive grain.

DETAILED DESCRIPTION OF THE INVENTION

EXAMPLE 1

Figure 1:
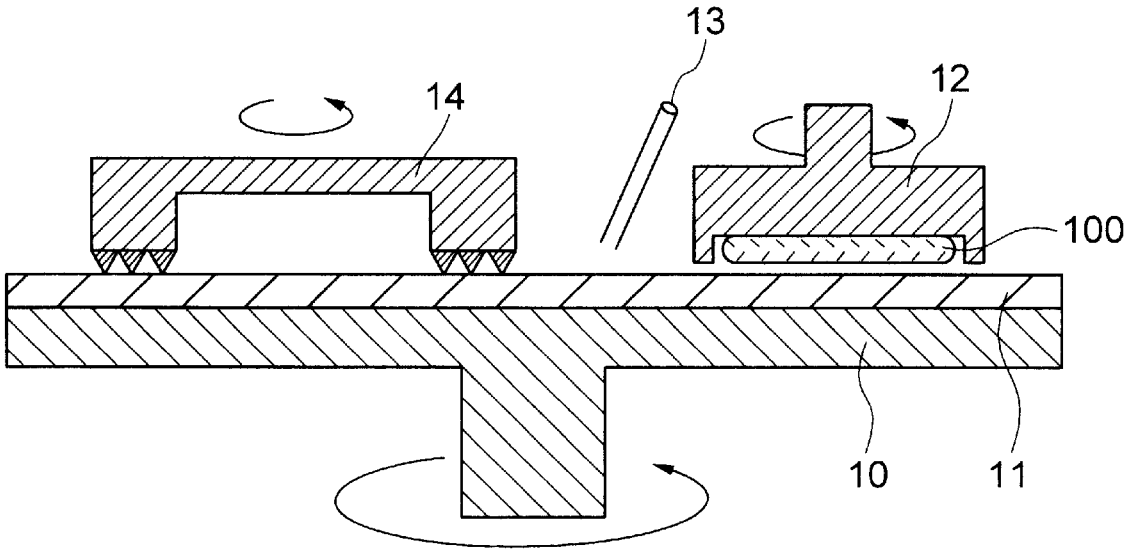
FIG. 1 is a cross section view of main portion of a polishing apparatus.

FIG. 1 shows a cross section of main portion of a polishing apparatus used in the present invention. A polishing pad 11 is adhered onto main surface of a rotational polishing platen 10, and slurry (not shown) containing substantially no abrasive grain, is supplied by a supply inlet 13. Size of the polishing pad 10 is eighteen inch in diameter in examples described below as long as there is not any notification. A wafer 100 consisting of four-inch-diameter silicon wafer, on surface of which one-micron-thickness Cu film (not shown) is formed, is pressed onto the polishing pad 11, with the wafer covered with a cover body covering the wafer or by a holder body (a carrier) 12 holding the wafer. A dresser 14 to process surface of the polishing pad (so-called "dressing"), is mounted on another main portion of the polishing platen 10, and textures the surface of the polishing pad by rotating it with pressing.

A foamed polyurethane resin pad, IC1000 (trade mark of RODEL) was used for the polishing pad 11. Ring shape dresser PCR-103 (trade mark of NANOFACTOR) was used for the dresser 14. As polishing solution for Cu, solution as described in JP-A-11-195628 was used, which contains malic acid as solvent for oxide layer, BTA as protection layer formation agent, and hydrogen peroxide as oxidizer. No abrasive grain is contained in the polishing solution. The polishing solution was supplied at flow rate of 50 milliliter per minute. To this slurry containing substantially no abrasive grain, surfactant for stabilization was added.

First, the wafer 100 was polished with polishing pressure thereon of 200 g/cm$^2$ while dressing was performed by the dresser 14 that was pressed with pressure of 110 gf/cm$^2$. Rotation speed of the polishing platen 10 was 90 rpm.

Figure 2:
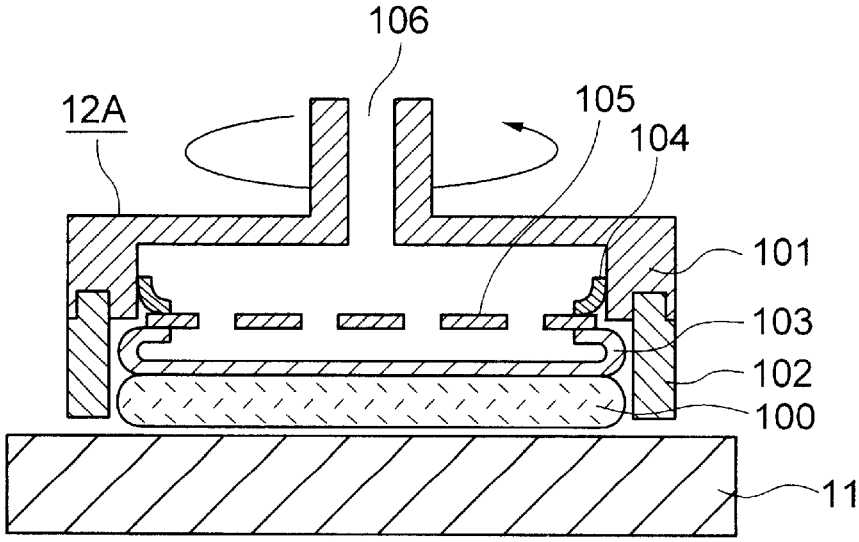
FIG. 2 is a detailed cross section view of main potion of a polishing apparatus.
Figure 3:
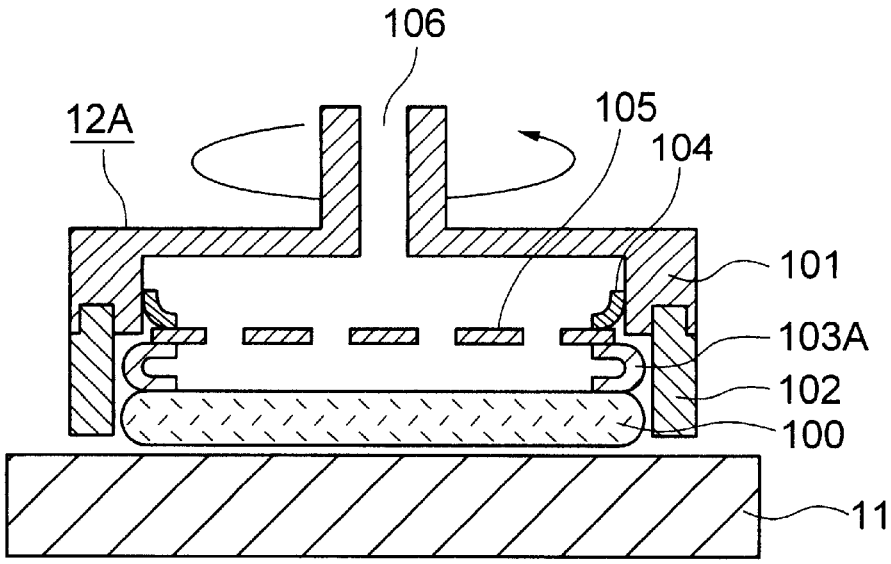
FIG. 3 is a detailed cross section view of main potion of another polishing apparatus.

FIG. 2 and FIG. 3 is detailed view of the structure of a cover body or carrier 12A that the inventor used. A case 101 in upper potion of the carrier 12A had inner space and open bottom portion. Onto lower side of the bottom potion, a workpiece receptor (or a retainer) 102 is attached in order to confine the wafer 100. The retainer 102 is made of resin with high wear resistance, for example, such as polyurethane, epoxide, nylon, polypropylene, or polyphenylsulfide.

In the case 101, a fexor member (flexor) 104 is provided, and inner edge of the flexor contacts closely with a support plate 105 to support a membrane. The support plate 105 has one or more openings for passing air, liquid, or the like therethrough, as described below.

A membrane 103 made of elastic material such as neoprene rubber with 0.5 mm thickness is also the support plate 105, lower side of the membrane contacts with backside of the wafer 100, and side of the membrane is opposing to retainer 102.

In the present invention, material that has elasticity such that it expands or restores the initial state depending on pressure of air or liquid described below, is suitable for the membrane 103. It preferably has resistant against at least fluid pressure of 500 gf/cm$^2$ as maximum.

The elastic membrane 103 is thus secured to the case 101, hence inner wall of a carrier 12A. The inner space of the case is made as sealed structure (referred to as "fluid bag structure") that is sealed from outer region, by using the case 101, the flexor 104, and the membrane 103 in combination. Fluid is introduced (injected) by introducing hole (injection inlet) 106 for fluid such as air or liquid, and the elastic membrane is expanded to contact closely with the backside of the wafer 100, and predetermined pressure is applied onto the backside of the wafer 100 in the direction toward the polishing platen 10 or the polishing pad 11. Such state is kept during polishing operation. Since the flexor 104 and the membrane 103 is made of flexible material and thus can be transformed, the wafer 100 may move up or down, be eccentric, and twist to certain extent with respect to the retainer 102.

FIG. 3 shows a structure in which openings are formed at least in a part of membrane 103A so that the wafer 100 is pressed directly by fluid. Thus, inner space of the carrier 12A inner is sealed by wall of the case 101, the flexor 104, the membrane 103A and the wafer 100 seal.

There is almost no difference in pressing mechanism for the wafer backside between FIG. 2 and FIG. 3. For simplification of explanation, a case of polishing apparatus with the fluid bag structure in FIG. 2 will be described hereafter. The occurring phenomena and provided effects are substantially the same in both cases.

Figure 4:
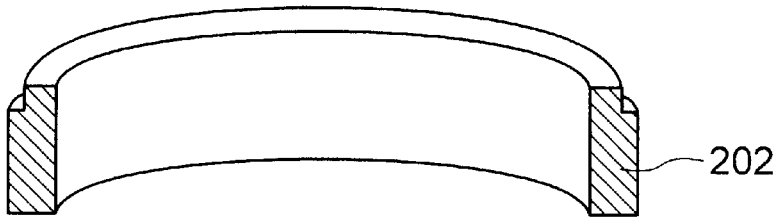
FIG. 4 is a partial perspective view of a retainer in a polishing apparatus.

For such a carrier 12A, a ring-shaped retainer 202 of epoxide resin, inner wall of which is smoothed in certain extent, is used as shown FIG. 4.

Figure 5:
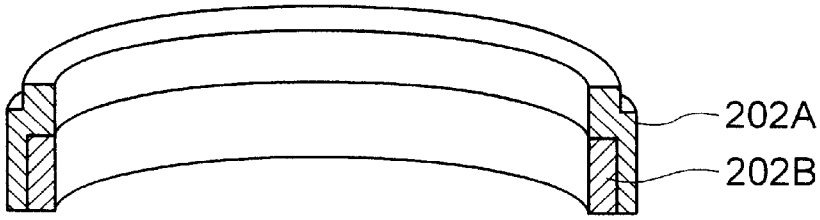
FIG. 5 is a partial perspective view of a retainer regarding an example of the present invention.

On the other hand, an example of the present invention is characterized that a retainer as shown in FIG. 5 is used. Body of a retainer 202A is made of epoxide resin, into at least potion of inner surface (or inner wall) in the retainer that may contact with membrane 103, a ring 202B of tetrafluoroethylene resin is embedded. Fluorocarbon resin such as trifluoroethylene resin or fluorovinylidene resin may be used instead of tetrafluoroethylene. The ring 202B has an effect that friction with membrane 103 is significantly reduced comparing to epoxide resin that is typically used.

Such a carrier in FIG. 5 was utilized in the polishing apparatus in FIG. 2, then polishing was performed over a sample wafer. The sample wafer was such that 50 nm tantalum then 800 nm copper had been stacked on a wafer in which oxides had been formed on its surface. As a result, stable polishing was provided during copper polishing, and high frequency noise was not generated. Polishing rate was 250 nm/min. However, at time when copper film polishing was completed and tantalum film was exposing, high frequency noise was generated. However, since the slurry is not intended for tantalum film polishing, there is not any problem in practice. In comparing tetrafluoroethylene resin with another resin, such as trifluoroethylene for example, tetrafluoroethylene resin is best in that its friction is lower. However, regarding wear resistance, it is not suitable, and a number of other fluororesins such as trifluoroethylene are better.

On the other hand, polishing was performed in same condition, by using the carrier mounted with a retainer of epoxide resin, inner surface of which had been smoothed. Since starting of polishing, large, high frequency noise was generated. Polishing rate of copper film was reduced to less than 50 nm/min, and much polishing damage occurred on surface, and polishing was not stable.

EXAMPLE 2

Figure 6:
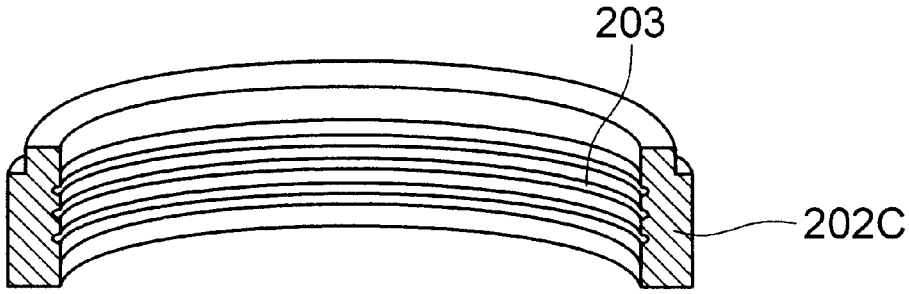
FIG. 6 is a partial perspective view of a retainer regarding another example of the present invention.
Figure 7:
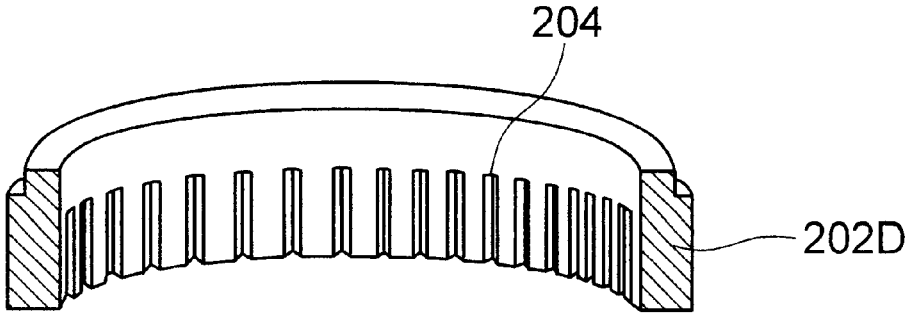
FIG. 7 is a partial perspective view of a retainer regarding another example of the present invention.

Polishing was performed in same condition as the example 1, except that a retainer shown in FIG. 6 or FIG. 7 was used.

Specifically, a retainer 202C of FIG. 6 is made from typical epoxide resin. In the retainer 202C, a plurality of grooves 203 with V-shape cross section of 10–500 micron depth are formed at least into inner wall that may contact with the membrane 103, substantially in parallel with surface (retainer polishing surface) of the retainer where retainer contacts with the polishing pad (hence laterally). It was founded that the depth variation of 10 to 500 micron was generated as follows. A retainer of resin is usually not accurate circle, and necessarily has a certain deformation. The retainer in this example was also deformed, thus depth of the deepest groove was 500 micron, and depth of the shallowest groove was 10 micron. Groove angle of the V-shaped groove 203 was about 90 degrees. The groove formation decreased surface area that can contacts with the membrane 103 (referred to as "effective surface area") to half of the initial one. Additionally, even if the membrane is pressed onto the retainer with said pressure, there is always slurry at bottom of the V-shape groove 203, sticking force between the membrane 103 and the retainer 202C can be thus substantially reduced.

In the case of an retainer 202D in FIG. 7, a plurality of V-shape grooves 204 of 10–100 micron depth is formed at least into inner wall of a part that may contact with membrane 103, in direction crossing with main surface of the polishing surface or polishing platen (hence longitudinally).

An carrier comprising such retainer structure 202C or 202D as shown FIG. 6 or FIG. 7 was employed in the polishing apparatus in FIG. 2, a sample consists of similar wafer as the example 1 (an interconnect substrate) was then polished. As a result, stable polishing was provided during copper polishing, and high frequency noise was not generated. Polishing rate was 250 nm/min. However, at time when copper film polishing was completed and tantalum film was exposing, high frequency noise was generated. However, the slurry is not intended for tantalum film polishing as described above, therefore there is not any problem in practice. In comparing the parallel lateral groove and the crossing longitudinal groove, the former has an advantage that it is easily machined, and the latter has a disadvantage that abrasive grain of slurry easily remain within the grooves while having an advantage that it is easy to inject or drain slurry and an advantage that retainer cleaning is easy.

EXAMPLE 3

Figure 8:
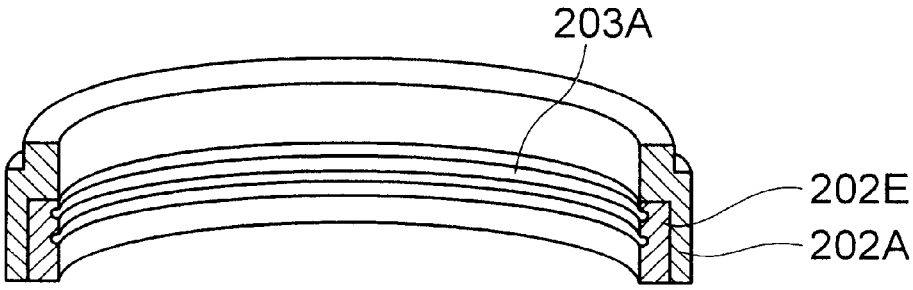
FIG. 8 is a partial perspective view of a retainer regarding still another example of the present invention.

A wafer was polished in same condition as the example 1, except that a retainer in FIG. 8 was used. The retainer 202A, 202C is made of material of typical epoxide resin. In the retainer, ring 202*a* made of tetrafluoro resin with low coefficient of friction is embedded into inner wall of a part that may contact with the membrane, and a plurality of grooves 203A with V-shaped cross section and about 100 micron depth is formed substantially in parallel with the polishing surface, hence laterally. Groove angle of the V-shaped groove 203A was about 90 degrees. Use of resin with low coefficient of friction as well as formation of the grooves allowed surface area that may contact with the membrane to decrease to half of the initial one.

A carrier with a retainer as shown in FIG. 8 is employed in a polishing apparatus, then a sample of wafer similar to one in the example 1 (an interconnect substrate) was polished. As a result, stable polishing was provided during copper polishing, and high frequency noise was not generated. Polishing rate was about 250 nm/min. Additionally, high frequency noise was not generated too when copper film polishing was completed and tantalum film was exposed.

Preferable conditions for the grooves as described in the example 2 or 3. If cross section shape of grooves is V-shape, it is easy to machine it. But cross section shape is not limited to the V-shape. If depth of V-shaped grooves is at least more than 1 micron, it is effective. This is because size of abrasive grain in slurry is often 50 nm or less, and the depth is preferably more than the size. In terms of the machinability, the depth of the V-shaped groove is preferably equal to or more than 10 micron. When only depth of the grooves is increased but the width is not increased so that effective surface area is reduced, the groove cross section may be inverted trapezoid. Reduction of groove angle of the groove or the side allows formation of more grooves. However, a problem occurs that foreign materials easily stick to them, resulting in difficulty in cleaning of the grooves. As the groove angle, 60 degree or more, preferably 90 degree or more is suitable. The machined surface may be also curved by making the grooves' cross section in partial arc or partial elliptic arc, or in their combination, although machining is difficult. The groove shape makes cleaning much easier. Longer life may be also provided due to lower membrane damage.

As an alternative method for the groove formation described above, it is effective to texture inner side (inner wall,) of the retainer. Height difference in the height variation of 1 micron or more is effective, however, height difference of 5 micron or more is preferable to make processing easier. The surface-texturing is simple process, for which sand blast process may be utilized, and has a problem that it is difficult to control repeatability of surface textured state. The problem that foreign material is easily built up may occur depending on the condition of the surface-texturing.

EXAMPLE 4

Figure 9:
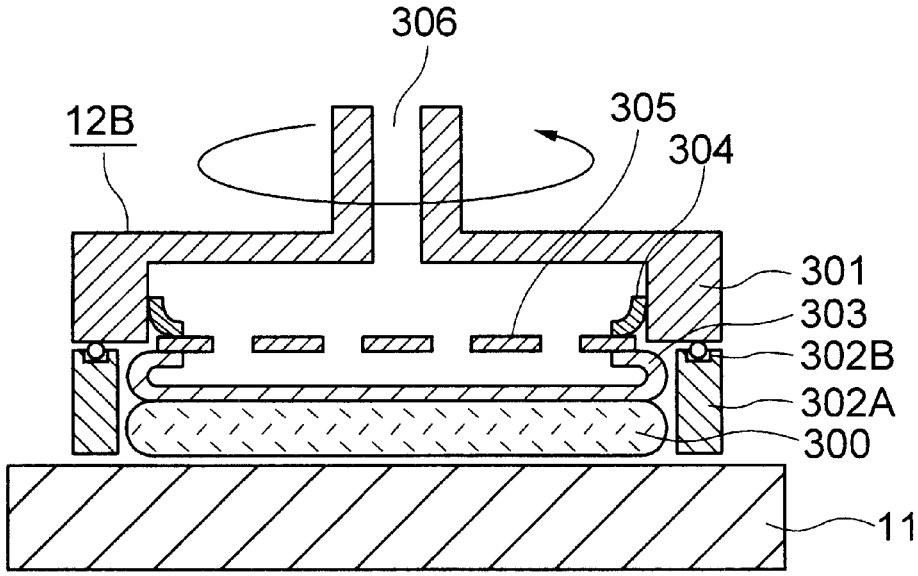
FIG. 9 is cross section view of main portion of polishing apparatus regarding another example of the present invention.

FIG. 9 is used for description. It is characterized in that configuration of retainer and case is different from above examples. In FIG. 9, a retainer 302A to confine a wafer (an interconnect substrate) 300A during polishing is rotatably mounted in lower portion (bottom portion) of a case (box body) 301 in an carrier 12B. For the retainer 302A, epoxide resin is used as a high wear resistive resin. To inner wall of the case 301, a flexor 304 made of neoprene rubber or the like is secured, and inner edge of the flexor is made contact closely with a support plate 305. To the support plate 305, a membrane 303 made of neoprene rubber or the like is secured, and lower surface of the membrane contacts with backside of the wafer (an interconnect substrate) 300, and side surface of the membrane opposing closely to the retainer 302A. Fluid is injected through a fluid injecting inlet (introducing hole) 306 in upper potion of the carrier 12B, pressing the wafer (the interconnect wafer) 300 with predetermined pressure.

In this example, the retainer 302A is mounted in bottom portion of the case 301 through a rotational mechanism 302B, and can thus rotate with respect to the case 301. The rotational mechanism 302B may be a bearing, or a sliding mechanism with low resistance made of low-friction material. In this example, the rotational mechanism 302B was made slidable by inserting a sheet of tetrafluoroethylene resin between the case 301 and the retainer 302A.

By using a polishing apparatus with such carrier, a sample of wafer similar to the one in the example 1 (an interconnect substrate) was polished. As a result, stable polishing was provided, and high frequency noise was not generated during copper polishing. Polishing rate was 250 nm/min. Additionally, high frequency noise was not generated too when copper film polishing was completed and tantalum film was exposed. This retainer structure was most suitable for prevention of unstable polishing, although it has a problem that the entire retainer structure was complicated. It is because unstable polishing discussed in the present invention should not be generated in principle. It also provides better cleaning performance since it is not needed to provide groove in inner surface of the retainer (surface of inner wall).

EXAMPLE 5

Figure 10:
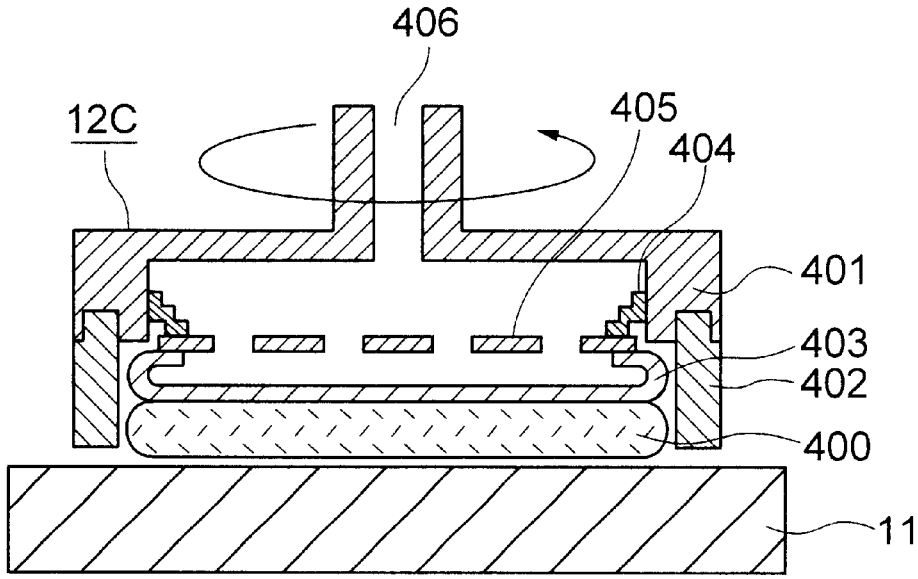
FIG. 10 is cross section view of main portion of polishing apparatus regarding still another example of the present invention.

FIG. 10 is used for description. In the figure, a carrier of this example is pressed onto the polishing pad 11, and polishing is performed. To lower surface (bottom portion) of a case (a box body) 401 of a carrier 12C, a retainer 402 to confine a wafer (a interconnect wafer) 400 during polishing, is mounted. The retainer 402 is made of trifluoroethylene resin. A flexor 404 made of thin plate of stainless steel with 0.1 mm thickness is secured to inner side (inner wall) of the case 401, and inner edge of the flexor is made closely contact with a support plate 405. To the support plate 405, a membrane 403 of neoprene rubber is also attached, and lower surface of the membrane 403 contacts with the wafer (an interconnect substrate) 400, and side surface of the membrane is opposing to the retainer 402. Predetermined pressure can be applied onto backside of the wafer (an interconnect substrate) 400 by injecting fluid through a fluid introducing hole (a injection inlet) 406.

Possibility that the membrane 403 contacts with the retainer 402, can be reduced extremely, or eliminated, since due to increased hardness of the flexor 404, the membrane 403 and the wafer (an interconnect substrate) 400 can move upward and downward in a certain extent with respect to the retainer 402 while eccentricity or deformation like twist does not easily occur.

Polishing similar to the example 1 is performed by using a polishing apparatus with such carrier. As a result, stable polishing was provided, and high frequency noise was not generated during copper polishing. Polishing rate was 250 nm/min. High frequency noise was not generated too after copper film polishing was completed and tantalum film was exposed. However, for this carrier structure, a caution should be made that the flexor 404 of stainless steel is expensive, and corrosion may occur depending on chemical composition of slurry.

EXAMPLE 6

An example in which a polishing apparatus according to the present invention is used in manufacturing of a semiconductor integrated circuit device, will be described with reference to FIG. 11 to FIG. 14 which show respective cross section of main portion for each process step. The polishing apparatus in this example had a structure wherein it comprised a carrier with a retainer of FIG. 8 as described in Example 6 of the present invention, and two polishing platens. Copper polishing is performed on a first polishing platen with slurry containing substantially no abrasive grain as the example 1, Polishing over tantalum-based barrier film is performed on a second platen. And, the insulator film and tangsten film are polished with another manufacturing machine (not shown). In this example, insulated-gate transistors are formed as semiconductor device. In the case of dynamic random access memory or the like, the process to form electrode plates for elements and the process after it, is substantially same as this example, while steps to form capacitors are added.

Polishing conditions for copper polishing were like following. Rotation speed of 18 inch diameter polishing platen was 100 rpm, polishing pressure was 200 gf/cm$^2$, flow rate of slurry containing substantially no abrasive grain was 0.1 litter/min, the polishing pad was IC1000 made of polyurethane foam resin, temperature during polishing was 28 Celsius degree.

Figure 11:
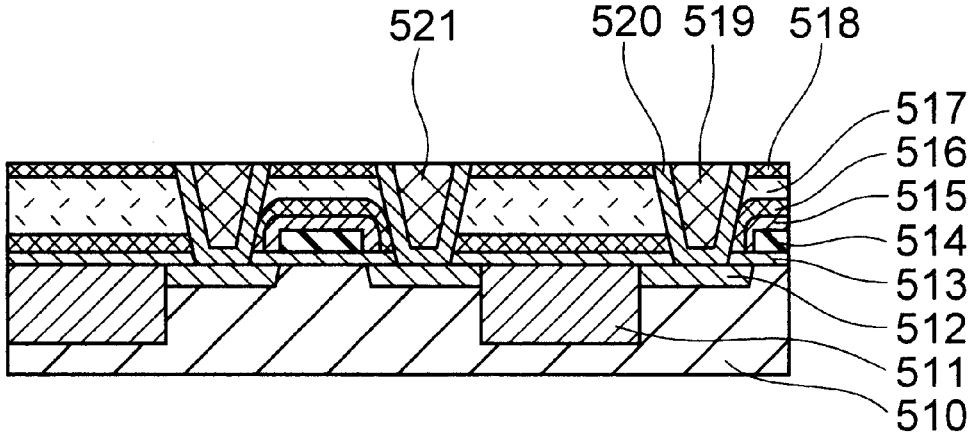
FIG. 11 is a cross section view to describe a manufacturing process of semiconductor integrated circuit device.

As shown in FIG. 11, embedded insulator layer 511 for isolating devices from each other was formed into surface of an interconnect substrate 510 comprised of 6 inch diameter silicon wafer containing p-type impurity. Its surface was planarized by polishing with alkali slurry containing silica abrasive grain and ammonia. Diffusion layers 512 (semiconductor region) containing n-type impurity were then formed by ion implantation, heat process, or the like, and gate insulator films 513 were then formed by thermal oxidation or the like. Gate electrodes 514 consisting of polycrystalline silicon, or stacked layer of refractory metal and polycrystalline silicon were then formed through processing. Onto surface of them, device protection film 515 made of silicon oxide, phosphorous doped silicon oxide or the like, and contamination prevention films 516 made of silicon nitride or the like, to prevent contaminant penetration from outside, were deposited. Planarized layer 517 made of silicon oxide (p-TEOS) formed by plasma chemical vapor deposition (plasma-CVD) using tetraethoxysilane (TEOS) as source material was formed in 1.5 micron thickness, and is removed by 0.8 micron by using typical insulator polishing technique, so as to be planarized. The surface of them was further coated with a second protection layers 518 of silicon nitride for preventing copper diffusion. Contact holes 519 for connection with device were then formed in predetermined portion, and stacked layer 520 of titanium, and titanium nitride layers for both adhesion and contamination prevention was then formed, and tungsten layer 521 was then formed into the holes. Polishing was applied over portion except hole region to form so-called plug structure.

The stacked layer 520 of titanium and titanium nitride is formed by reactive sputtering or plasma-CVD. Tungsten may be also formed by sputtering or CVD. At that time, size of contact holes 519 were generally 0.25 micron or less in diameter, and 0.8 to 0.9 micron in depth. If elements for dynamic random access memory are formed, the depth may be increased further, for example up to 1 micron or more. Thickness of the stacked layer 520 was about 50 nm at planar potion. Thickness of the tungsten layer 521 was about 0.6 micron. The reason for them is to bury the contact holes 519 substantially, and to facilitate tungsten polishing by improving planarity of the film surface. For polishing tungsten and the stacked layer of titanium nitride or the like, mixture slurry made from slurry SS-2000 (trade mark of CABOT) containing silica abrasive grain and hydrogen peroxide as oxidizer are used. Polishing conditions other than conditions for slurry were same as above examples. Tungsten layer 521 may be also polished by using polishing apparatus comprising slurry containing substantially no abrasive grain and a carrier according to the present invention, and stacked layer 520 may be then polished and removed by using conventional slurry containing abrasive grain.

Figure 12:
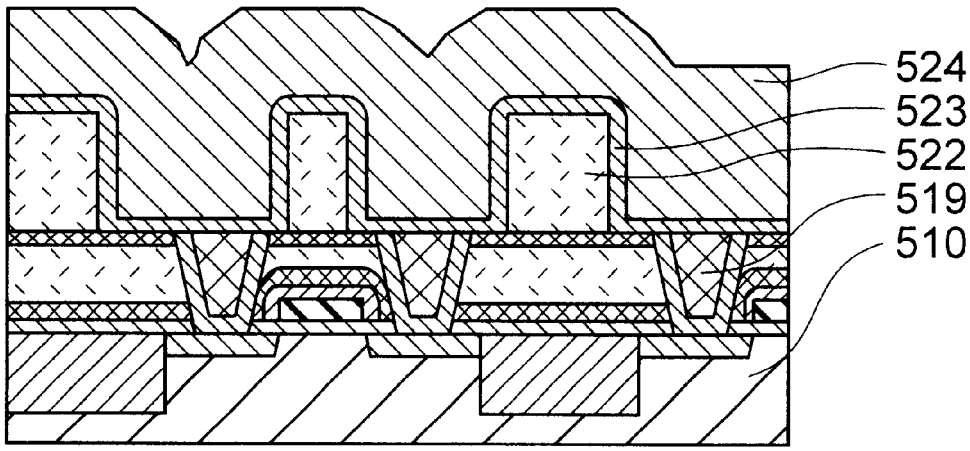
FIG. 12 is a cross section view to describe a manufacturing process of semiconductor integrated circuit device.

Next, as shown FIG. 12, a first inter-level insulator layer 522 was formed, and trenches for interconnect was formed, and a first lower metal layer 523 of 50 nm titanium nitride, then a first upper metal layer 524 of copper film were formed. Thickness of the first inter-level insulator film 522 was 0.5 micron. While dry etching technique was used to form the trenches, the second protection layer 518 of silicon nitride served as a stopper against the etching. Since etching rate for silicon nitride is about one-fifth of one for silicon oxide, the thickness was 10 nm. Copper of 0.7 micron thickness was formed as the first upper layer metal layer 524 by electroplating process, and was annealed at about 350 Celsius degree. The first upper metal layer 524 was polished by using polishing apparatus with a carrier according to the present invention. Another polishing apparatus other than the apparatus used for the plug polishing, may be utilized if it is needed to prevent copper contamination in the contact holes. The first lower metal layer 523 was polished by using mixture slurry which was prepared by adding 0.2 weight percent BTA to mixture made from slurry SS-W2000 (trade mark of CABOT) and hydrogen peroxide, and by using a second polishing platen (not show) in a second polishing apparatus. The reason for this is to reduce polishing rate of the first upper metal layer. In the process, when polishing the first lower metal layer 523, IC1400 (trade mark of RODEL), a stacked structure made of upper layer of polyurethane foam resin and lower layer of flexible resin layer was used as a polishing pad. This polishing pad has an advantage that due to soft polishing pad, polishing damage is not easily generated, providing higher interconnect yield although planarizing effect is decreased comparing to IC1000 pad. This is to avoid possibility that if there are complicated structures such as active device or interconnect in lower level than polished layer, mechanical strength of the interconnect substrate 510 is reduced resulting in easy generation of polishing damage.

A second contamination prevention film 525 of silicon nitride was formed on the surface after polishing by plasma-CVD technique. Thickness of the layer was 20 nm.

If a variety of active devices are formed on surface of a wafer (an interconnect substrate) 510 as this example, causing large complicated surface height difference, surface of the first inter-level insulator layer 522 is not sufficiently planarized so that shallow wide depressions with about 5 nm depth and about same width as devices such as 5 micron for example, are left, even if the planarization layer 517 has been polished. If characteristics of the slurry containing substantially no abrasive grain are very good such that it does not generate dishing or the like, polishing residue of the first upper metal layer 524 may be then left even in such shallow depressions. In such case, the residue of the first upper metal layer 524, if they are, can be stably eliminated during polishing of the first lower metal layer 523, by adjusting BTA concentration added to slurry made from SS-W2000 and hydrogen peroxide so that thus prepare slurry has also property to polish the first upper metal layer in certain extent.

Figure 13:
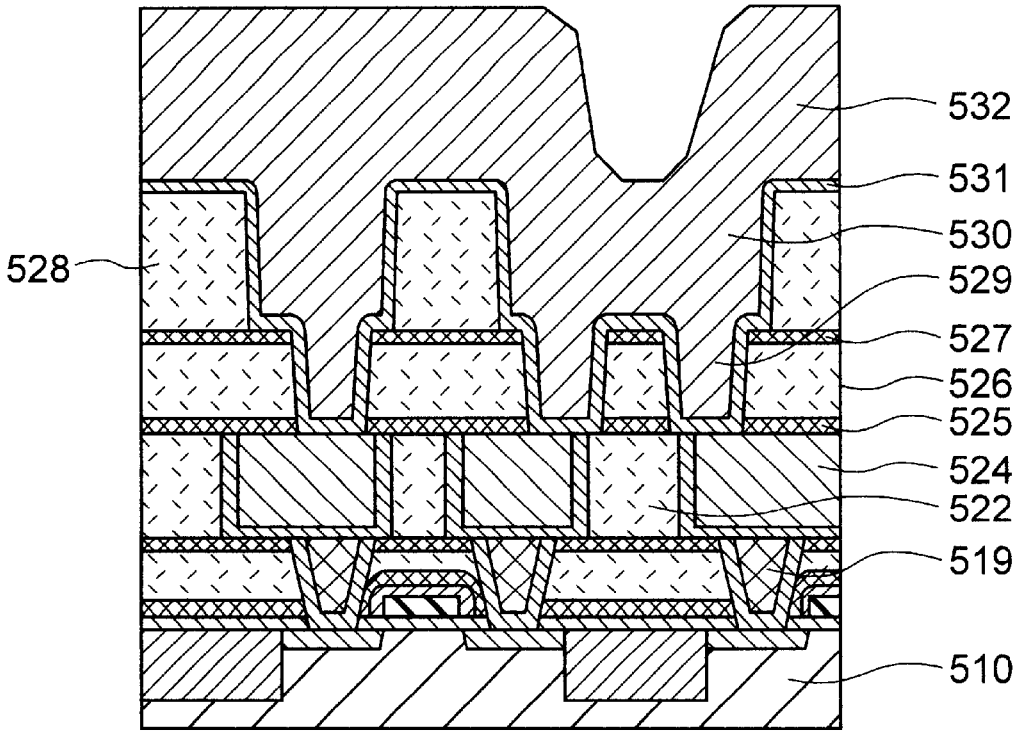
FIG. 13 is a cross section view to describe a manufacturing process of semiconductor integrated circuit device.

Next, a p-TEOS film of 0.7 micron thickness was formed as a second inter-level insulator film 526, the surface was planarized by 0.2 micron depth by a typical insulator polishing technique with alkali-based slurry. This planarization was intended to eliminate height difference generated during polishing process of the first upper metal layer 524 in the lower level, or the like. A plasma-CVD silicon nitride film of 0.2 micron thickness was then formed as a third contamination prevention film 527, and a p-TEOS film of 0.7 micron thickness was formed as a third inter-level insulator film 528. First inter-level connection holes 529 and second interconnect trench 530 were formed by using typical photolithography technique and reactive dry etching, so that surface of the first upper metal layer 524 was exposed. In formation of such trench pattern with two-step structure, the silicon nitride film serves as an etching stopper. Over the two-step structure thus formed, a silicon nitride film of 50 nm thickness was formed as a second lower metal layer 531 by plasma-CVD. A copper film of 1.2 micron thickness was formed as a second upper metal layer 532 by electroplating method, as shown in FIG. 13, and then annealed at 350 Celsius degree.

Figure 14:
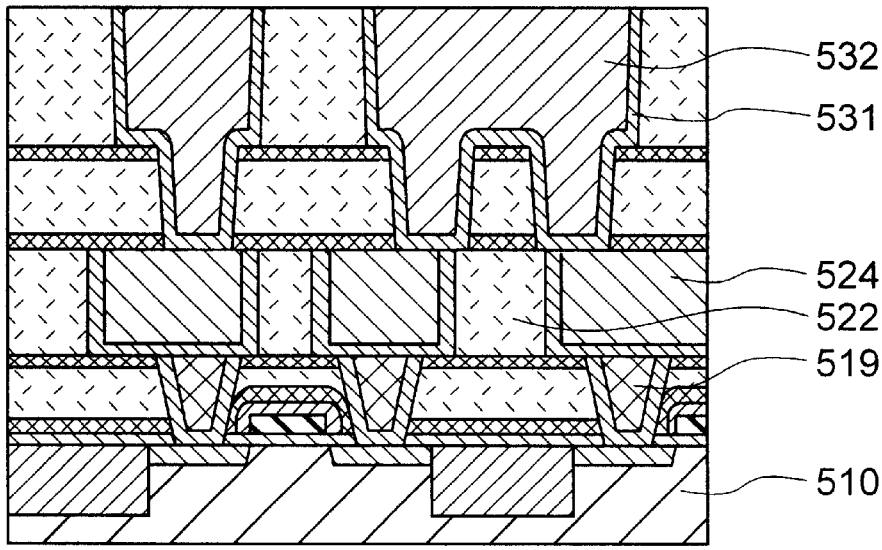
FIG. 14 is a cross section view to describe a manufacturing process of semiconductor integrated circuit device.

Next, the second upper metal layer 532 was polished for 5 minute (equivalent to 20% over polishing) for planarization by combination of polishing apparatus with the carrier of the present invention and slurry containing substantially no abrasive grain, and the second lower metal layer 531 was polished on a second polishing platen (not shown) at polishing rate of about 200 nm/min with aforementioned BTA-added slurry made from SS-W2000 and hydrogen peroxide, so that as shown in FIG. 14, two-level copper interconnect with damascene process and dual damascene process was formed. The polishing condition was same as one of the polishing applied the first upper and lower metal layers, except polishing time.

As described above, by utilizing insulator polishing process and two-step polishing process for copper and stacked layer, a multilayer interconnection can be formed with high yield while maintaining good planarity in the surfaces of the respective insulator films and metal layers, providing manufacturing of high performance, large scale semiconductor integrated circuit devices.

While it has been described about manufacturing process of semiconductor integrated circuit devices and polishing apparatuses used for it, it should be appreciated that the present invention is not limited such examples and can be applied a variety of surface planarizations over surface of other workpieces having surface with fine height variation thereon.

According to the present invention, when a metal film such as copper is polished with slurry containing substantially no abrasive grain, stable film polishing is provided by combining use of a polishing apparatus with fluid pressing mechanism that provides good polishing uniformity, and use of the slurry containing substantially no abrasive grain. Polishing apparatus with fluid pressing mechanism are suitable for uniform polishing over a wafer surface. In order to improve uniformity, support mechanism wherein a wafer is pressed onto a polishing pad softly, is used. Therefore, a wafer is eccentric with respect to the center of a carrier, or twists, during polishing. When slurry containing substantially no abrasive grain is used, since the friction is lower than friction for conventional slurry with abrasive grain, wafer vibration due to unstable eccentricity is easily generated, causing unstable polishing. The present invention essentially reduces the vibration, providing uniform polishing with low damage.

Additionally, since single polishing apparatus according to the present invention can be used regardless of amount of abrasive grain contained in slurry, operation and maintenance of apparatus itself are easy.

What is claimed is:

1. A polishing apparatus, comprising a cover body which is opened at a bottom thereof, has a space therein, and has an elastic membrane indirectly secured to or in a portion of an inner wall thereof through a flexor and a support plate, a surface of the inner wall in a portion at which the secured elastic membrane may contact due to flex of the membrane or the flexor being made of fluororesin, wherein the cover body covers a side and a backside surface of a workpiece placed on a polishing pad on a polishing platen, a surface of the workpiece is polished by providing relative motion between the polishing platen and the workpiece while fluid introduced into an upper space above the elastic membrane expands the elastic membrane to press the backside of the workpiece in a direction toward the polishing platen.

2. The polishing apparatus according to claim 1, wherein a plurality of lateral or longitudinal grooves are provided into the surface of the inner wall comprising fluororesin, and wherein the workpiece is polished with the elastic membrane contacting with the surface of the inner wall.

3. The polishing apparatus according to claim 1, wherein said fluororesin is selected from the group consisting of tetrafluoroethylene, trifluoroethylene and fluorovinylidene.

4. The polishing apparatus according to claim 1, wherein the cover body comprises a retainer covering the side surface of the workpiece.

5. The polishing apparatus according to claim 4, wherein the retainer comprises a body portion and a ring of fluororesin embedded in the inner wall of the body portion.

6. The polishing apparatus according to claim 5, wherein said fluororesin is selected from the group consisting of tetrafluoroethylene, trifluoroethylene and fluorovinylidene.

7. The polishing apparatus according to claim 6, wherein the body portion is made of epoxide resin.

8. The polishing apparatus according to claim 5, wherein the body portion is made of epoxide resin.

9. A polishing apparatus, comprising a rotational polishing platen and a rotational cover body arranged such that it opposes a main surface of the polishing platen through a workpiece, wherein a bottom of the cover body is opened, the cover body has space therein, an elastic membrane is secured indirectly to or in a portion of an inner wall of the cover body through a flexor and a support plate, the cover body has an introducing inlet that introduces fluid into space above the elastic membrane, and a surface of the inner wall in a portion at which the elastic membrane may contact due to flex of the membrane or the flexor comprises fluororesin.

10. The polishing apparatus according to claim 9, wherein said fluororesin is selected from the group consisting of tetrafluoroethylene, trifluoroethylene and flurovinylidene.

11. The polishing apparatus according to claim 9, wherein the cover body comprises a retainer covering the side surface of the workpiece.

12. The polishing apparatus according to claim 11, wherein the retainer comprises a body portion and a ring of fluororesin embedded in the inner wall of the body portion.

13. The polishing apparatus according to claim 12, wherein said fluororesin is selected from the group consisting of tetrafluoroethylene, trifluoroethylene and fluorovinylidene.

14. The polishing apparatus according to claim 13, wherein the body portion is made of epoxide resin.

15. The polishing apparatus according to claim 12, wherein the body portion is made of epoxide resin.

* * * * *